United States Patent [19]

Garner et al.

[11] 4,128,99(

[45] Dec. 12, 197

[54] CHLORITE CONTAINING PYROTECHNIC COMPOSITION AND METHOD OF INFLATING AN INFLATABLE AUTOMOBILE SAFETY RESTRAINT

[75] Inventors: Eugene F. Garner; Brian K. Hamilton, both of Canyon Country, Calif.

[73] Assignee: Allied Chemical Corporation, Morris Township, Morris County, N.J.

[21] Appl. No.: 856,958

[22] Filed: Dec. 5, 1977

[51] Int. Cl.[2] ..... C06D 5/06; C06B 45/10

[52] U.S. Cl. ..... 60/205; 149/19.6; 149/19.91; 149/77; 149/82; 149/83; 149/85; 422/232

[58] Field of Search ..... 149/19.6, 19.91, 77, 149/82, 83, 85; 60/205; 23/281

[56] References Cited

U.S. PATENT DOCUMENTS

| | | | |
|---|---|---|---|
| 2,995,526 | 8/1961 | De Ment | 149/77 |
| 3,055,781 | 9/1962 | Yamamoto | 149/19.6 |
| 3,692,495 | 9/1972 | Schneiter et al. | 23/281 |
| 3,773,351 | 11/1973 | Catanzarite | 23/281 |
| 3,785,149 | 1/1974 | Timmerman | 149/83 |
| 3,862,866 | 1/1975 | Timmerman et al. | 149/77 |
| 3,901,747 | 8/1975 | Garner | 149/77 |
| 3,912,562 | 10/1975 | Garner | 149/82 |
| 3,936,330 | 2/1976 | Dergazarian et al. | 149/77 |
| 3,964,255 | 6/1976 | Catanzarite | 149/77 |
| 3,986,908 | 10/1976 | Grébert et al. | 149/83 |

*Primary Examiner*—Edward A. Miller
*Attorney, Agent, or Firm*—Roger H. Criss; Patrick L. Henry

[57] ABSTRACT

A pyrotechnic composition comprising:

about 1 to 20% by weight of a thermoplastic resin se lected from the group consisting of polyacetal resins polyvinyl acetate resins and mixtures thereof;

about 30 to 80% by weight of an alkali metal chlorite such as sodium chlorite or potassium chlorite; and about 20 to 60% by weight of a coolant selected fron the group consisting of calcium hydroxide, magnesiun hydroxide or mixtures thereof.

The invention also relates to a method of inflating a inflatable automobile safety restraint comprising th step of substantially completely inflating the restrain with the gaseous composition products of combustio of a composition comprising:

about 1 to 20% by weight of a thermoplastic resin se lected from the group consisting of polyacetal resins polyvinyl acetate resins and mixtures thereof;

about 30 to 80% by weight of an alkali metal chlorite such as sodium chlorite or potassium chlorite; and about 20 to 60% by weight of a coolant selected fron the group consisting of calcium hydroxide, magnesiun hydroxide or mixtures thereof.

10 Claims, No Drawings

CHLORITE CONTAINING PYROTECHNIC COMPOSITION AND METHOD OF INFLATING AN INFLATABLE AUTOMOBILE SAFETY RESTRAINT

CROSS REFERENCE TO RELATED APPLICATION

Reference is made to copending application Ser. Nos. 840,692 and 840,693 filed Oct. 11, 1977.

BACKGROUND OF THE INVENTION

1. Field of the Invention

This invention relates to pyrotechnic compositions and especially such compositions which are useful in inflating an inflatable automobile safety restraint, as well as to methods for so inflating the restraint.

2. Description of the Prior Art

Various pyrotechnic formulations have been proposed for generating a gas upon combustion in order to inflate an air bag or similar safety restraint in a vehicle so as to restrain movement of an occupant in the event of a sudden deceleration of the vehicle, such as caused by a collision. Exemplary of the many patents issued in this area are the following U.S. Patents: No. 3,785,149 to Timmerman; No. 3,897,285 to Hamilton et al.; No. 3,901,747 and No. 3,912,562 to Garner; No. 3,950,009 to Hamilton and No. 3,964,255 to Catanzarite.

In order to be employed as a pyrotechnic gas generating composition for inflatable occupant restraints, several criteria must be met. The pyrotechnic must be capable of producing non-toxic, non-flammable and essentially smokeless gases over a wide range of temperatures and other environmental conditions. The gases that are generated must be at a sufficiently low temperature so as not to destroy the restraint or injure the occupant. The pyrotechnic must be safe to handle, preferably with very low or no toxicity and must be capable of generating a substantial amount of gas within a very short period of time, e.g., less than about 100 milliseconds.

The present leading candidates for commercialization in an all-pyrotechnic inflation system are sodium azide-based compositions. Such compositions exhibit excellent gas generating properties and produce a gas which consists almost totally of non-toxic nitrogen gas. However, there has been some concern raised respecting the safe handling of sodium azide. It would be desirable to provide a pyrotechnic composition and method of inflating an air bag or the like which exhibited gas generating properties akin to sodium azide but which is relatively non-toxic. It would also be desirable to provide a composition and method in which all of the above criteria are maximized.

SUMMARY OF THE INVENTION

In accordance with this invention, there is provided a pyrotechnic composition comprising:

about 1 to 20% by weight of a thermoplastic resin selected from the group consisting of polyacetal resins, polyvinyl acetate resins and mixtures thereof;

about 30 to 80% by weight of an alkali metal chlorite; and about 20 to 60% by weight of a coolant selected from the group consisting of calcium hydroxide, magnesium hydroxide or mixtures thereof.

In further accordance with this invention, there is provided a method of inflating an inflatable automobile safety restraint comprising the step of substantially completely inflating the restraint with the gaseous composition products of combustion of a composition comprising:

about 1 to 20% by weight of a thermoplastic resin selected from the group consisting of polyacetal resins, polyvinyl acetate resins and mixtures thereof;

about 30 to 80% by weight of an alkali metal chlorite; and about 20 to 60% by weight of a coolant selected from the group consisting of calcium hydroxide, magnesium hydroxide or mixtures thereof.

It has been found that the above composition provides excellent inflation of safety restraints within the necessary inflation times, the resulting gaseous mixture is essentially non-toxic, non-flammable and smokeless and has a relatively low flame temperature (e.g., less than about 2000° F.). The pyrotechnic ingredients themselves have relatively low toxicity and are readily available.

DESCRIPTION OF THE PREFERRED EMBODIMENTS

In accordance with a preferred embodiment of this invention, the pyrotechnic composition comprises:

about 15 to 30, preferably about 5 to 15, weight percent of a thermoplastic resin selected from the group consisting of polyacetal resins, polyvinyl acetate resins and mixtures thereof;

about 30 to 80, preferably about 40 to 60, weight percent of an alkali metal chlorite, such as sodium chlorite or potassium chlorite; and about 20 to 60, preferably about 30 to 50, weight percent of a coolant selected from the group consisting of calcium hydroxide, magnesium hydroxide or mixtures thereof. The most preferred composition comprises a polyacetal resin, sodium chlorite and calcium hydroxide.

The polyacetal resin may be an acetal homopolymer (e.g., polyformaldehyde) or a copolymer (e.g., based on trioxane). An example of the former is the resin sold under the designation "Delrin" and an example of the latter is the resin sold under the designation "Celcon".

The polyacetal or polyvinyl acetate component of the pyrotechnic composition of this invention provides the fuel for the combustion; the alkali metal chlorite is an oxidizer and the calcium or magnesium hydroxide is a coolant. The composition of this invention may be prepared by any suitable powder or pellet blending process known to those skilled in the art. The composition of this invention preferably consists essentially of the three components enumerated above; however, for example, since the resultant mixture is white in color and hence is highly reflective, it may be preferred to include a pigment as a burn rate modifier. The preferred pigment is carbon black; other pigments that may alternatively be employed are black iron oxide, red iron oxide, black copper oxide and organic dyes. The amount of pigment in the composition may vary, but preferably is in the range of about 0.01 to 0.5 weight percent of the composition, more preferably about 0.05 to 0.15 weight percent.

It has been found that the pyrotechnic composition of this invention provides gaseous products which consist essentially of an optimum blend of oxygen, carbon dioxide and water vapor; such as about 20% $O_2$, 20% $CO_2$ and 60% $H_2O$, by volume. It is necessary to limit the amount of oxygen gas produced by the composition ince it supports combustion and it is necessary to limit ıe amount of carbon dioxide produced because in high oncentrations in a closed environment (e.g., a passener compartment of a vehicle) it can be toxic.

In order to further describe the present invention, the ɔllowing non-limiting examples are given.

EXAMPLE 1

A pyrotechnic composition consisting of 8.3 weight ercent of an acetal copolymer havng a melt index of 9 ɔold under the designation "Celcon"), 41.3 weight ercent calcium hydroxide, 50.4 weight percent sodium hlorite and 0.1 weight percent carbon black was intiıately mixed by ball milling under methylene chloride, ried and pressed into pellets. The pellets were then ıressed into a slug measuring about 2 inches (5 cm) long nd 1 inch (2.5 cm) in diameter. The slug was inserted ıto a cylindrical steel casing and the exposed end of the lug, to which a nozzle was attached, was ignited. A urn rate of 1 inch (2.5 cm) per second was measured at 000 psi. This rate is acceptable for automobile safety estraint pyrotechnic compositions and is similar to that xhibited by azide compositions. The gaseous output vas calculated to be as follows: 1800° F. combustion emperature; on a volume basis; 20% $O_2$, 20% $CO_2$ and 0% $H_2O$.

EXAMPLE 2

A pyrotechnic composition is prepared by blending bout 15 weight percent polyvinyl acetate, about 40 veight percent potassium chlorite and about 45 weight ercent magnesium hydroxide. The composition is ested as in Example 1 and similar results are noted.

EXAMPLE 3

Example 1 is repeated except that polyvinyl acetate is ubstituted for polyacetal. Similar results are noted.

EXAMPLE 4

Example 1 is repeated except that magnesium hyıroxide is substituted for calcium hydroxide. Similar esults are noted.

It is to be understood that variations and modificaions of the present invention may be made without leparting from the scope thereof. It is also to be undertood that the present invention is not to be limited by he specific embodiments disclosed herein but only in ccordance with the appended claims when read in ight of the foregoing specification.

We claim:

1. A pyrotechnic composition comprising:
   - from about 1 to 20% by weight of a thermoplastic resin selected from the group consisting of polyacetal resins, polyvinyl acetate resins and mixtures thereof;
   - from about 30 to 80% by weight of an alkali metal chlorite; and
   - from about 20 to 60% by weight of a coolant selected from the group consisting of calcium hydroxide, magnesium hydroxide or mixtures thereof.

2. The composition of claim 1 wherein said composition comprises:
   - from about 1 to 15% by weight of a polyacetal resin;
   - from about 40 to 60% by weight of sodium chlorite; and
   - from about 30 to 50% by weight of calcium hydroxide.

3. The pyrotechnic composition of claim 2 wherein said composition further includes about 0.01 to 0.5% by weight of a pigment.

4. The composition of claim 3 wherein said pigment is carbon black.

5. The composition of claim 1 wherein said thermoplastic resin is a polyacetal resin, said alkali metal chlorite is sodium chlorite and said coolant is calcium hydroxide.

6. A method of inflating an inflatable automobile safety restraint comprising the step of substantially completely inflating the restraint with the gaseous composition products of combustion of a composition comprising:
   - about 1 to 20% by weight of a thermoplastic resin selected from the group consisting of polyacetal resins, polyvinyl acetate resins and mixtures thereof;
   - about 30 to 80% by weight of an alkali metal chlorite; and
   - about 20 to 60% by weight of a coolant selected from the group consisting of calcium hydroxide, magnesium hydroxide or mixtures thereof.

7. The method of claim 6 wherein said composition comprises:
   - about 5 to 15% by weight of a polyacetal resin,
   - about 40 to 60% by weight of sodium chlorate; and
   - about 20 to 60% by weight of coolant selected from the group consisting of calcium hydroxide, magnesium hydroxide or mixtures thereof.

8. The composition of claim 7 wherein said composition further includes from about 0.01 to 0.05% by weight of a pigment.

9. The composition of claim 8 wherein said pigment is carbon black.

10. The composition of claim 6 wherein said thermoplastic resin is a polyacetal resin, said alkali metal chlorite is sodium chlorite and said coolant is calcium hydroxide.

* * * * *